US012228020B2

(12) United States Patent
Ellis, Jr.

(10) Patent No.: US 12,228,020 B2
(45) Date of Patent: Feb. 18, 2025

(54) DEVICES, SYSTEMS, AND METHODS FOR GAS LIFT GAS

(71) Applicant: LIFTROCK, LLC, Granbury, TX (US)

(72) Inventor: Billy Joe Ellis, Jr., Granbury, TX (US)

(73) Assignee: Liftrock, LLC, Granbury, TX (US)

( * ) Notice: Subject to any disclaimer, the term of this patent is extended or adjusted under 35 U.S.C. 154(b) by 0 days.

(21) Appl. No.: 18/531,122

(22) Filed: Dec. 6, 2023

(65) Prior Publication Data

US 2024/0191606 A1 Jun. 13, 2024

Related U.S. Application Data

(60) Provisional application No. 63/431,493, filed on Dec. 9, 2022.

(51) Int. Cl.
*E21B 43/12* (2006.01)
*E21B 43/40* (2006.01)

(52) U.S. Cl.
CPC ..... *E21B 43/122* (2013.01); *E21B 43/40* (2013.01)

(58) Field of Classification Search
CPC ..... E21B 43/122; E21B 43/40
See application file for complete search history.

(56) References Cited

U.S. PATENT DOCUMENTS 2,895,305 A 7/1959 Reed
2,975,724 A 3/1961 Welchon
3,260,308 A 7/1966 Cryer
4,606,703 A 8/1986 Baines
4,711,306 A * 12/1987 Bobo ..... E21B 43/122 166/267
4,896,725 A * 1/1990 Parker ..... E21B 43/122 166/57
4,929,348 A * 5/1990 Rice ..... E21B 43/122 210/414
7,299,879 B2 * 11/2007 Irwin, Jr. ..... E21B 43/122 166/372
8,757,271 B2 6/2014 Senties
9,932,807 B2 * 4/2018 Zhang ..... E21B 43/166
(Continued)

FOREIGN PATENT DOCUMENTS

WO WO-2009023589 A1 * 2/2009 ..... E21B 43/122
WO 2017078244 A1 5/2017
WO WO-2020167521 A1 * 8/2020 ..... E21B 21/08

OTHER PUBLICATIONS

International Search Report mailed Oct. 16, 2019 for PCT/US19/36625.

(Continued)

*Primary Examiner* — Aaron L Lembo
(74) *Attorney, Agent, or Firm* — Barnes & Thornburg LLP; Steven D. Shipe

(57) ABSTRACT

Devices, systems, and methods are disclosed concerning gas lift gas recovery. A gas lift gas recovery system can include an inlet separator system, charge system, and sump system for facilitating recovery of gas lift gas. The inlet separator system can be configured to receive production fluid for separation of liquids therefrom to recover gas lift gas. The charge system can include a high pressure (HP) leg for holding an HP portion of fluid and a low pressure (LP) leg for holding an LP portion of fluid. The sump system can be configured for holding liquids from at least one of the inlet separator system and the charge system.

29 Claims, 5 Drawing Sheets

(56) References Cited

U.S. PATENT DOCUMENTS

| | | | | |
|---|---|---|---|---|
| 10,519,983 | B1 * | 12/2019 | Ellis, Jr. | F04F 1/20 |
| 11,441,401 | B2 * | 9/2022 | Shaw | E21B 47/10 |
| 11,566,501 | B2 * | 1/2023 | Moneyhun | E21B 43/122 |
| 2008/0179063 | A1 | 7/2008 | Smith | |
| 2010/0116491 | A1 | 5/2010 | Daniels | |
| 2018/0320637 | A1 | 8/2018 | Lee | |
| 2019/0120029 | A1 * | 4/2019 | Knight | E21B 43/40 |
| 2020/0270975 | A1 * | 8/2020 | Whiteman | E21B 43/34 |
| 2021/0301634 | A1 * | 9/2021 | Moneyhun | E21B 43/34 |

OTHER PUBLICATIONS

International Preliminary Report on Patentability mailed Dec. 15, 2020 for PCT/US19/36625.

* cited by examiner

DEVICES, SYSTEMS, AND METHODS FOR GAS LIFT GAS

CROSS-REFERENCE

This utility patent application claims the benefit of priority to U.S. Provisional Application No. 63/431,493, entitled "METHODS AND APPARATUS FOR QUICKSET GAS LIFT SEPARATION AND LIQUID STORAGE WITHOUT ATMOSPHERIC GAS VENTING," filed on Dec. 9, 2022, the contents of which are hereby incorporated by reference in their entirety, including without limitation, those portions concerning fluids management.

FIELD

Devices, systems, and methods within the present disclosure concern fluids management in oil and gas production. More specifically, devices, systems, and methods within the present disclosure concern management of preferable fluids in oil and gas production.

In the oil and gas industry, gas lift technology can apply high-pressure gas for supplementing formation gas to raise or lift well fluids. Typically, in the production of oil from oil wells with assistance from gas lift systems, gas that is separated from the produced oil is compressed and recycled for further use in production of oil from the well. After the compression stage, the separated gas is returned to the production wells as gas lift gas. In typical gas lift systems, fluids produced from the separation process are sent elsewhere such as to offsite use or routed into haul off tanks. Handling of various fluids can lead to emissions, such as release of gaseous emissions into the atmosphere during transfer to haul off tanks, for example, during a dump cycle. Further, liquids that are stored can evaporate, losing/releasing other gas emissions to the atmosphere. Other sources of unproductive emissions can include gaseous emissions from compressor packing vents associated with compressors. Designs for reducing and/or containing discharges can assist in reducing or eliminating atmospheric emissions.

SUMMARY

According to an aspect of the present disclosure, a gas lift gas recovery system includes an inlet separator system, a charge system, and a sump system for holding liquids from at least one of the inlet separator system and the charge system. The inlet separator system may be configured to receive production fluid for separation of liquids therefrom to recover gas lift gas. The inlet separator system may include at least one separator vessel for separation of liquids from gas. The at least one separator vessel may include a production inlet to receive production fluid from a well, a gas lift gas outlet for connection with a gas lift gas compressor system, and a liquid outlet. The charge system may include a high pressure (HP) leg for holding an HP portion of fluid and a low pressure (LP) leg for holding an LP portion of fluid. The charge system may include at least a liquid inlet for selective communication with the liquid outlet of the inlet separator to receive liquids. The sump system may include a sump vessel arranged for selective communication with the charge system via a vapor line to transfer vaporous release to the charge system. In some embodiments, the a gas lift gas recovery system may include a control system for operation to conduct selective communication of fluids, wherein the control system is configured to selectively communicate the sump system with at least one of the inlet separator system and the charge system to transfer liquids to the sump system.

In some embodiments, the control system may include a charge gas valve for communicating pressurized charge gas to the sump system. The control system may include a sump outlet valve for purging liquids from the sump system. The control system may be configured to open the sump outlet valve and the charge gas valve in response to a threshold sump fluid level within the sump vessel to purge liquids from the sump vessel.

In some embodiments, the control system may include a sump vapor control valve operable between a closed position to block against communication of vaporous release to the charge system and an open position to fluidly communicate the sump system with the charge system to transfer vaporous fluids to the charge system. The control system may be configured to close the sump vapor control valve in response to sump purging operations. The control system may be configured to close one or more valves arranged for selective communication of liquid to the sump system in response to the sump purging operations.

In some embodiments, the sump system may be arranged to receive selective communication of liquid from at least one of a fuel gas scrubber system, a suction scrubber, a first interstage scrubber, and a drain of a gas lift gas compressor system. The liquid from the at least one of a fuel gas scrubber system, a suction scrubber, a first interstage scrubber, and a drain of a gas lift gas compressor system may be an LP liquid for selective communication to the sump system via a valve of the control system.

In some embodiments, the charge system may be arranged to receive selective communication of liquid from at least one of a second interstage scrubber and a third interstage scrubber. The liquid from the at least one of a second interstage scrubber and a third interstage scrubber may be an HP liquid for selective communication to the HP leg of the charge system. The liquid from the at least one of a second interstage scrubber and a third interstage scrubber may be arranged for selective communication from the HP leg of the charge system to the sump system via an HP sump valve of the control system.

In some embodiments, the inlet separator system may be arranged in selective communication with the sump system to provide liquids via a separator sump valve of the control system. The inlet separator system may be arranged in selective communication with the charge system. The control system may be configured to selectively communicate liquids from the inlet separator system to the charge system in response to threshold liquid level within the inlet separator system during dump cycle operation of the sump system for purging liquids from the sump vessel.

In some embodiments, the gas lift gas recovery system is skid mounted. In some embodiments, the gas lift gas recovery system further includes a methane recovery system for recovering hydrocarbon gas. The methane recovery system may include a methane recovery compressor for increasing pressure of recovered gas. Pressurized gas from the methane recovery compressor may be provided to the inlet separator for combination with recovered gas lift gas.

In some embodiments, the methane recovery system may include a cooling system. The cooling system may include a heat transfer fluid circulating in thermal communication to remove heat from the methane recovery system and provide recovered heat to the sump system. In some embodiments, the sump system may include a heat exchanger arranged to provide thermal communication between the heat transfer fluid and the sump vessel to provide heat to the liquids within the sump vessel for encouraging vaporization.

In some embodiments, the control system may be configured to selectively communicate the sump system with the inlet separator system to transfer liquids to the sump system in response to threshold liquid level within the at least one of the inlet separator system. In some embodiments, during sump purging operation, the control system may be configured to divert fluids from the inlet separator system to the LP leg in response to threshold liquid level within the inlet separator system during sump purging operations.

In some embodiments, the control system may be configured to maintain communication of liquid from the LP leg to the sump system outside of sump purging operations. The control system may be configured to selectively communicate the sump system with the HP leg of the charge system to transfer liquids to the sump system in response to threshold liquid level within the HP leg.

According to another aspect of the present disclosure, a gas lift gas recovery system may include an inlet separator system configured to receive production fluid for separation of liquids therefrom to recover gas lift gas, a charge system, and a sump system for holding liquids from at least one of the inlet separator system and the charge system. The inlet separator system may include at least one separator vessel for receiving production fluid from a well and separating liquids from gas within the production fluid. The charge system may include a high pressure (HP) leg for holding an HP portion of fluid and a low pressure (LP) leg for holding an LP portion of fluid, and may include a liquid inlet for selective communication with the inlet separator system to receive liquids. The sump system may include a sump vessel arranged for selective communication with the charge system to transfer vaporous release to the charge system. In some embodiments, the gas lift gas recovery system may include a control system for operation to conduct selective communication of fluids. The control system may be configured to selectively communicate the sump system with at least one of the inlet separator system and the charge system to transfer liquids to the sump system. In some embodiments, the gas lift gas recovery system may include a methane recovery system for recovering methane from at least one of the sump system and the charge system.

In some embodiments, the methane recovery system may include a methane recovery compressor for increasing pressure of recovered gas. Pressurized gas from the methane recovery compressor may be provided to the inlet separator for combination with recovered gas lift gas.

In some embodiments, the gas lift gas recovery system may include a skid on which at least the inlet separator system, the charge system, and the sump system are mounted. The methane recovery system may be mounted on the skid. The control system is mounted on the skid.

According to another aspect of the present disclosure, a gas lift gas preparation system includes a gas lift gas recovery system for recovering gas lift gas from well production fluid, and a gas compression system for compression of recovered gas lift gas. The gas lift gas recovery system may include an inlet separator system configured to receive production fluid for separation of liquids therefrom to recover gas lift gas, the inlet separator system may include at least one separator vessel for receiving production fluid from a well and separating liquids from gas within the production fluid; a charge system which may include a high pressure (HP) leg for holding an HP portion of fluid and a low pressure (LP) leg for holding an LP portion of fluid, and may include a liquid inlet for selective communication with the inlet separator system to receive liquids; and a sump system for holding liquids from at least one of the inlet separator system and the charge system, the sump system may include a sump vessel arranged for selective communication with the charge system to transfer vaporous release to the charge system. In some embodiments, the gas lift gas recovery system may include a control system for operation to conduct selective communication of fluids. The control system may be configured to selectively communicate the sump system with at least one of the inlet separator system and the charge system to transfer liquids to the sump system. In some embodiments, the gas compression system may compress recovered gas lift gas from the inlet separator system. The gas compression system may include at least one compressor arranged for communication with the inlet separator system to receive recovered gas lift gas, and in communication to provide compressed gas lift gas for gas lift.

In some embodiments, the gas compression system may be arranged in selective communication with the gas lift gas recovery system to transfer liquid to the gas lift gas recovery system. The gas compression system may be arranged in selective communication with the charge system to transfer liquid to the charge system. The gas compression system may be arranged in selective communication with the LP leg of the charge system to transfer LP liquids to the LP leg.

In some embodiments, the gas compression system may include an inlet scrubber arranged in selective communication with the LP leg of the charge system to transfer LP liquids. The gas compression system may arranged in selective communication with the HP leg of the charge system to transfer HP liquids. In some embodiments, the gas compression system may include at least one interstage scrubber arranged in selective communication with the HP leg of the charge system to transfer HP liquids. The at least one interstage scrubber may be arranged between different stages of compression of the gas compression system.

In some embodiments, the gas lift gas recovery system may be mounted on a skid. The gas compression system may not be mounted on the skid.

In some embodiments, the gas lift gas preparation system may further include a methane recovery system for recovering hydrocarbon gas. The methane recovery system may include a methane recovery compressor for increasing pressure of recovered gas. The methane recovery system may be configured to receive ultra low pressure methane gas emissions from the gas compression system for recovery compression.

In some embodiments, pressurized gas from the methane recovery compressor may be provided to the inlet separator for combination with recovered gas lift gas. The methane recovery system may include a cooling system. The cooling system may include a heat transfer fluid circulating in thermal communication to remove heat from the methane recovery system and provide recovered heat to the sump system. In some embodiments, the sump system may include a heat exchanger arranged to provide thermal communication between the heat transfer fluid and the sump vessel to provide heat to the liquids within the sump vessel for encouraging vaporization.

In some embodiments, the sump system may be arranged in selective communication with a liquid recovery path. The liquid recovery path may include a pipeline to off-site storage reserve. The liquid recovery path may include a transport fill terminal for communication with transport storage vessels.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the disclosure is not limited to specific methods and instrumentalities disclosed herein.

DESCRIPTION

While methods, systems and devices are described herein by way of examples and embodiments, those skilled in the art recognize the methods, systems and devices are not limited to the embodiments or drawings described. It should be understood that the drawings and description are not intended to be limited to the particular form disclosed. Rather, the intention is to cover all modifications, equivalents and alternatives falling within the spirit and scope of the appended claims and description.

Facilitating production gas to separate out and recycle gas lift gas for use in obtaining oil from wells, and for separating an obtaining fluids from gas lift gas, can be challenging. Such carbon intense environments, in oil and gas industry, can incur unproductive emissions which can lower production and/or increase emissions generally. Reducing such emissions can yield benefits in production rates and/or environmental impacts.

Figure 1:
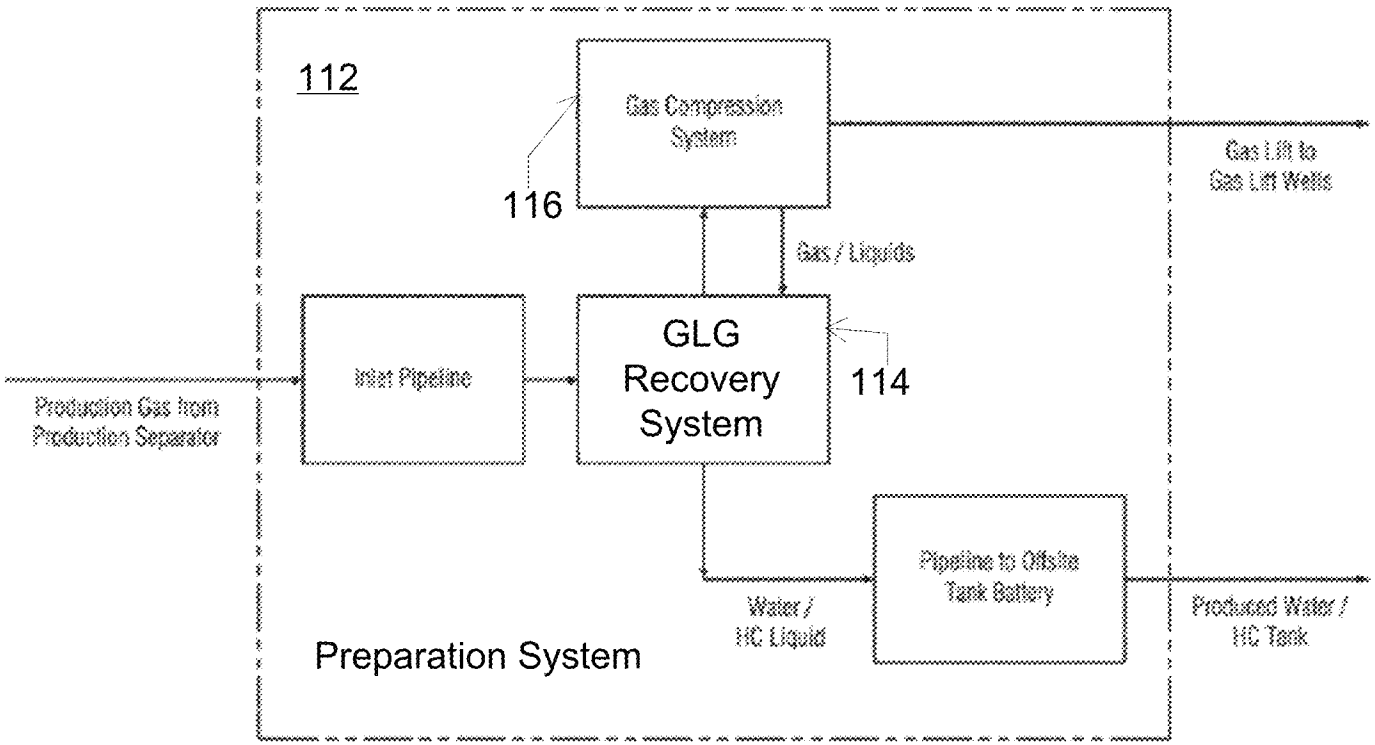
FIG. 1 is an exemplary schematic view of an overall facility including a gas lift gas preparation system including a gas lift gas recovery system in accordance with embodiments of the present disclosure.

Referring to FIG. 1, a diagram of a facility illustratively includes a gas lift gas preparation system 112 for fluid management in well production. In the illustratively embodiment, the gas lift gas preparation system 112 includes a gas lift gas recovery system 114 for recovering gas lift gas from production fluids, and a gas compression system 116 for increasing the pressure of gas recovered by the gas lift gas recovery system 114 for return to use as gas lift gas for the well(s). A general workflow of the processing of production gas according to the present disclosure is shown including inlet of production gas via an inlet pipeline to the gas lift gas recovery system 114, communication of recovered gas to the gas compression system 116, and outlet of gas lift gas to the wells. Outlet liquids can be directed out from the gas lift gas compression system 114 for other use and/or treatment (e.g., offsite). In the illustrative embodiment, the inlet production gas is provided from a production separator, but in some embodiments, may be provided from any suitable manner of source.

Figure 2:
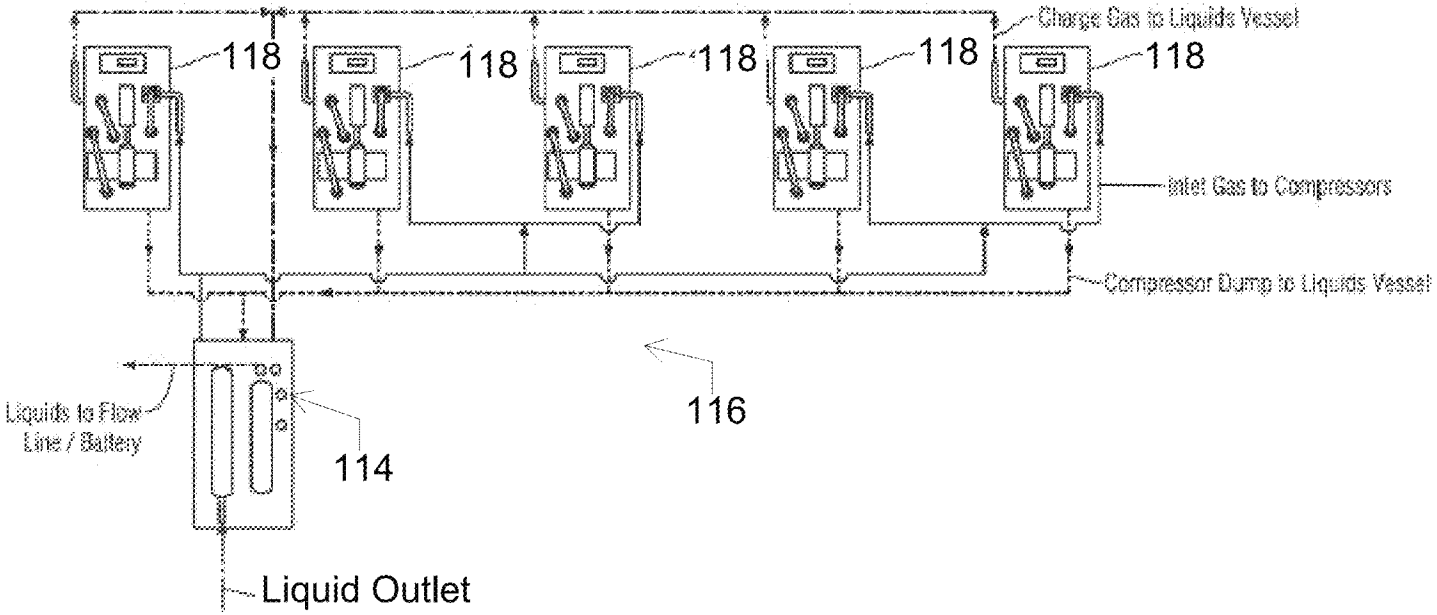
FIG. 2 depicts another schematic view of the overall facility shown in FIG. 1 in accordance with embodiments of the present disclosure.

Referring to FIG. 2, a workflow relative to FIG. 1 is illustratively depicted in which the gas compression system 116 includes five gas compression subsystems connected to the gas lift gas recovery system 114. In the illustrative embodiment, the gas lift gas recovery system 114 provides recovered gas to the gas compression system 116, and can receive liquid collected from the gas compression system 116 for management. For example, gas compression system 116 may include one or more stages of gas scrubbers 115 for gas treatment in connection with the compression processes which can produce liquid streams. High pressure charge gas can be provided from the gas compression system 116 to the gas lift gas recovery system 114 to assist with fluid management, for example in purging fluids from the gas lift gas recovery system 114, as discussed in additional detail herein.

Figure 3:
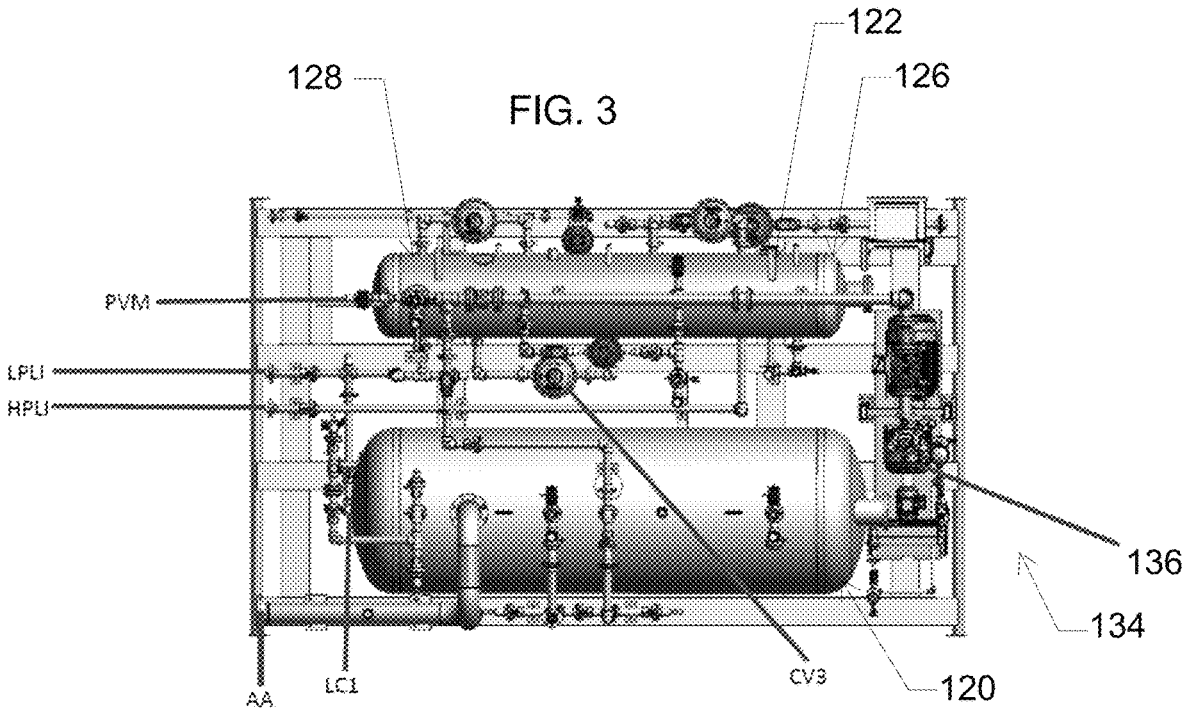
FIG. 3 depicts a plan view of the gas lift gas recovery system in accordance with embodiments of the present disclosure.
Figure 4:
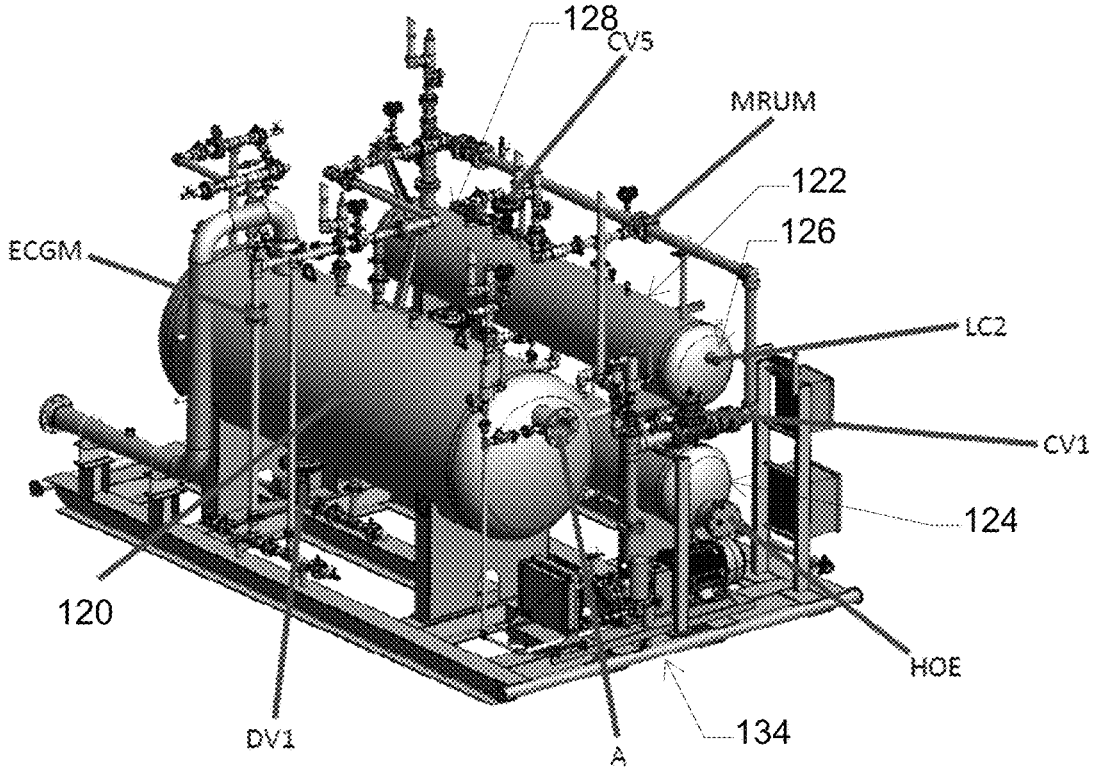
FIG. 4 is a perspective elevation-front view of the gas lift gas recovery system in accordance with embodiments of the present disclosure.
Figure 5:
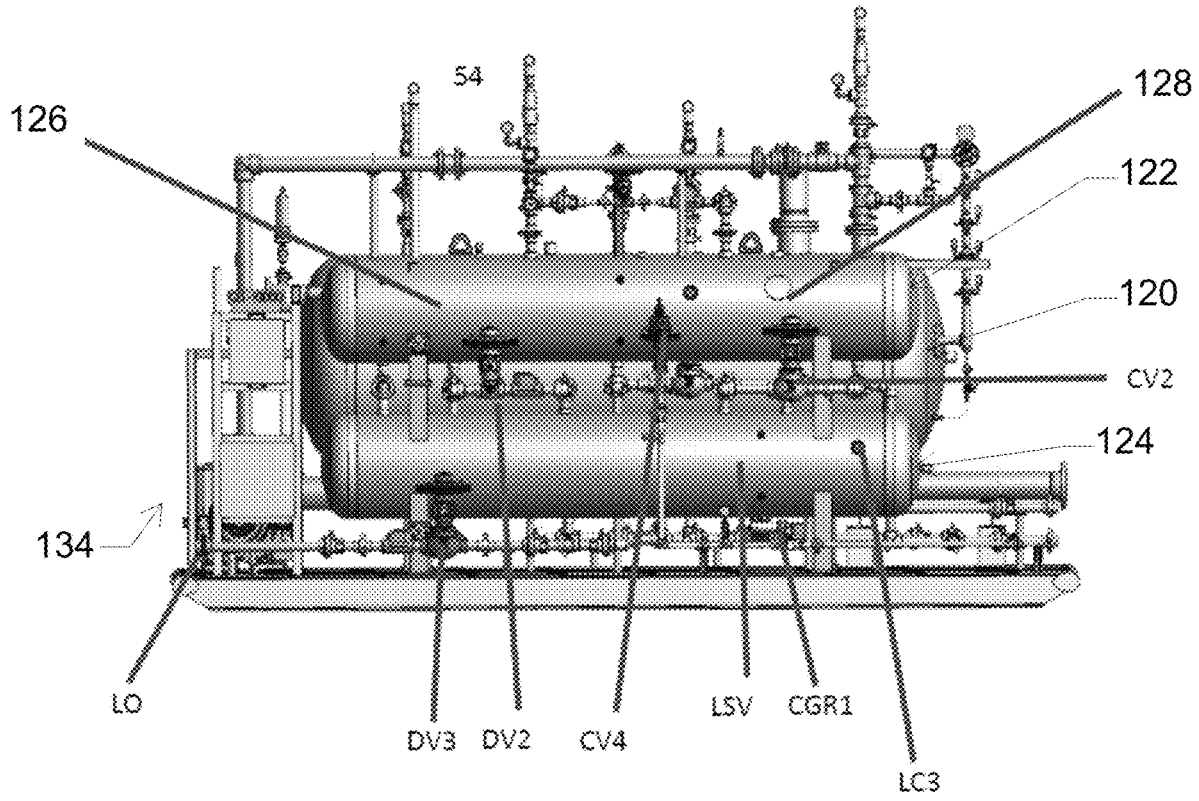
FIG. 5 is a rear elevation view of the gas lift gas recovery system in accordance with embodiments of the present disclosure.

Referring now to FIGS. 3-5, the gas lift gas recovery system 14 illustratively includes an inlet separator system 120 for separating gaseous fluids from liquids (and/or fluidized solids) fluids, a charge system 122 for holding fluids for separation and/or management, and a sump system 124 for storing liquids. The inlet separator system 120 illustratively comprises a vessel having one or more inlets, outlets, and interior features for promoting separation of gaseous and liquid fluids, for example, including a production gas inlet for receiving production gas, at least one liquid outlet for communicating liquids to the charge system 122 and/or sump system 124, as discussed in additional detail herein.

Production gas provided to the inlet separator system 120 may include entrained liquids and/or may condense gaseous fluids into liquids during transfer. Gaseous fluids which are separated out from the production gas stream can be communicated to the gas compression system 116 for pressurization.

The charge system 122 illustratively includes a charge vessel comprising high pressure (HP) leg 126 for holding HP fluids and low pressure (LP) leg 128 for holding LP fluids. In the illustrative embodiment, the legs 126, 128 are separate vessel spaces within shared structure, but in some embodiments, the legs 126, 128 may be entirely separate structures.

High pressure fluids, generally liquids, can be selectively communicated to the HP leg 126 from HP sources, such as later stages of compression and/or scrubbers of the gas compression system 116. Liquids within the HP leg 126 can be selectively communicated to the sump system 124. Gaseous fluids within the HP leg 126 can be selectively communicated to the LP leg 128.

Low pressure fluids, generally liquids (and/or fluidized solids), can be selectively communicated to the LP leg 126 from LP sources. Such LP sources can include early stages of compression and/or scrubbers from the gas compression system 116. Liquids entering the LP leg 128 can be permitted to evaporate or flash into gaseous fluids within the LP leg 128. Gaseous fluids within the LP leg 126 can be selectively communicated to the inlet separator system 120.

In the illustrative embodiment, the gas lift gas recovery system 114 includes a methane recovery system 134 for recovering hydrocarbon gases, such as methane. The methane recovery system 134 includes a compressor 136 for increasing the pressure of recovered hydrocarbon gases. Recovered hydrocarbon gases are communicated to the inlet separator system 120. Such recovered gases can increase the amount of recovered gas lift gas overall. In some embodiments, any suitable pressurization manner may be applied, and/or recovered hydrocarbon gas from the charge system 122 may be provided (e.g., pumped) at current pressure into the inlet separator system 120 and may be permitted to condense, at least partially, within the inlet separator system 120.

The sump system 124 is arranged for holding liquids in assistance to the gas lift gas recovery operations. The sump system 124 illustratively includes a sump vessel arranged in selective communication with the inlet separator system 120 and charge system 122 to selectively receive respective fluids for management in conjunction with the other gas lift gas recovery operations.

In the illustrative embodiment, the sump system 124 can receive selective communication of fluids from each of the inlet separator system 120, LP sources, and the HP leg 126 of the charge system 122 individually. Gaseous fluids within the sump system 124 can be selectively communicated to the charge system 122 for further recovery. In the illustrative embodiments, gaseous fluids from the sump system 134 can be selectively communicated with the LP leg 28 of the charge system 122. In some embodiments, the sump system 124 may include a heating system 130 having a heating device 132 for encouraging vaporization of fluids within the sump system 124, as discussed in additional detail herein.

The sump system 124 can communicate liquids for recovery. The recovered liquids from the sump system 124 can be communicated to long term storage, haul-off tanks (e.g., stationary, rail, or truck), and/or to transport pipeline, whether on or offsite. Charge gas can be provided to the sump system 124 to temporarily increase pressure within the sump system 124 to assist in transferring liquids from the sump system 124 to a recovery path for recovery.

Figure 6:
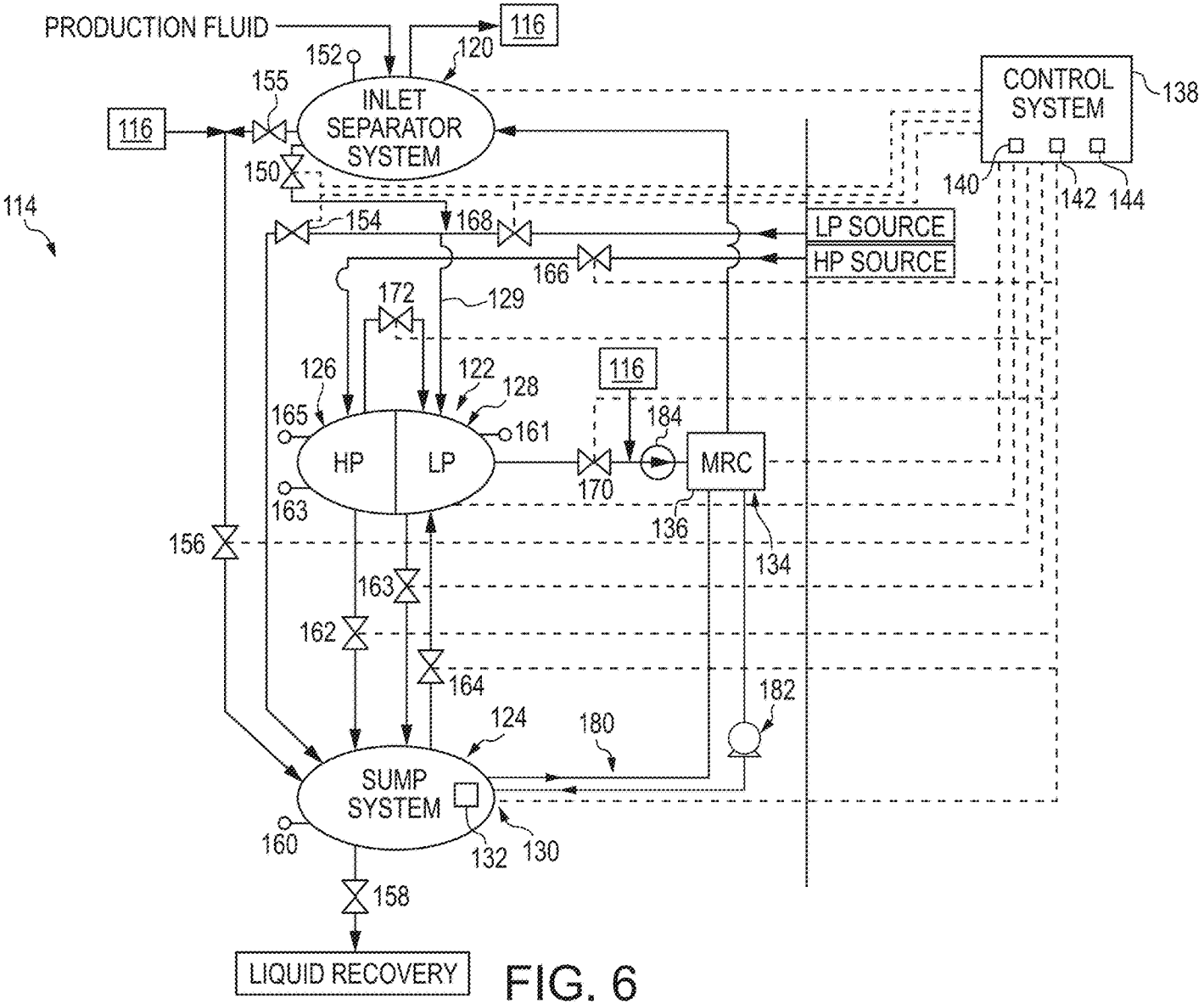
FIG. 6 is a diagrammatic view of the gas lift gas recovery system illustrating an inlet separator system, charge system, and sump system in accordance with embodiments of the present disclosure.

Referring now to FIG. 6, in the illustrative embodiment, the gas lift gas recovery system 114 includes a control system 138 for governing recovery operations. The control system 138 illustratively includes a processor 140 for executing instructions stored on memory 142, and communications circuitry 144 for communicating signals to/from processor 140 in support of recovery operations under governance of the processor 140.

Examples of suitable processors may include one or more microprocessors, integrated circuits, system-on-a-chips (SoC), among others. Examples of suitable memory, may include one or more primary storage and/or non-primary storage (e.g., secondary, tertiary, etc. storage); permanent, semi-permanent, and/or temporary storage; and/or memory storage devices including but not limited to hard drives (e.g., magnetic, solid state), optical discs (e.g., CD-ROM, DVD-ROM), RAM (e.g., DRAM, SRAM, DRDRAM), ROM (e.g., PROM, EPROM, EEPROM, Flash EEPROM), volatile, and/or non-volatile memory; among others. Communications circuitry can include components for facilitating processor operations; for example, suitable components may include transmitters, receivers, modulators, demodulators, filters, modems, analog/digital (AD or DA) converters, diodes, switches, operational amplifiers, and/or integrated circuits.

In some embodiments, the control system 138 may communicate with external systems and/or devices. For example, in the illustrative embodiment, the gas compression system 116 operates independently, but in some embodiments, may communicate with control system 138 and/or may be governed by control system 138. In some embodiments, other servers or resources (e.g., physical, virtual, cloud, internet, intranet, etc.) may provide information for use by the gas lift gas recovery system 114.

Still referring to FIG. 6, the control system 138 illustratively includes various valves and instrumentation for governing selective communication of fluids. Although for sake of description, such valves and/or instrumentation (e.g., detectors, etc.) are generally considered part of the control system 138, valves and/or instrumentation can be considered part of the overall system and/or subsystems arranged in communication with the control system 138 for governing operations. Valves are generally operable between a closed position blocking against flow of fluids and an open position permitting the flow of fluids for selective communication of fluids between areas, systems, or sub-systems.

The control system 138 illustratively includes a separator sump valve 150 operable to selectively communicate fluids (generally liquids) to the sump system 124 from the inlet separator 120. Responsive to detection of threshold liquid level within the inlet separator system 120, via level detector 152, the control system 138 operates the separator sump valve 150 from closed to open to communicate liquids therethrough towards the sump system 124. In the illustrative embodiment, the separator sump valve 150 is arranged to communicate liquids to the sump system 124 via a LP valve 154 which is operated by the control system 138 to divert fluids to the sump system 124 responsive to the threshold liquid level within the inlet separator system 120 when the sump system 124 is not under sump evacuation operations. When the sump system 124 is under sump evacuation operations, the LP valve 154 is closed and opening of the separator sump valve 150 causing liquids from the inlet separator system 120 to flow to the LP leg 128 (until opening of the LP valve 154 to communication liquid of the LP leg 128 to the sump system 128). The control system 138 illustratively operates the separator sump valve 150 open until achieving a threshold acceptable liquid level in the inlet separator system 120, but in some embodiments, any suitable control manner may be applied, for example, for a predetermined time period before closing.

As mentioned above, charge gas can be provided to the sump system 124 to assist with evacuating liquids. During such evacuating operations, the control system 138 operates a charge gas valve 156 from closed to open to communicate high pressure charge gas therethrough to the sump system 124 to increase pressure within the sump system 124 to facilitate evacuation to a the liquid recovery path via sump outlet valve 158. In the illustrative embodiment, charge gas is provided from other high pressure sources, such as the gas compression system 116, but in some embodiments, may be provided from the inlet separator system 120 (via valve 155) and/or any other suitable source depending on the pressure needs for evacuation of the sump system 124. The control system 138 illustratively operates the charge gas valve 156 and sump outlet valve 158 to open responsive to detection of threshold liquid level in the sump system 124, via level detector 160, in such sump evacuation operations. During such sump evacuation operations, the control system 138 operates other valves communicating with the sump system 124 to close, for example, charge sump valve 162 and/or sump vapor control valve 164.

As previously mentioned, upon occurrence of a threshold liquid level within the inlet separator system 120 during or close-in-time with the sump evacuation operations, the control system 138 responsively operates the LP valve 154 to direct fluids to the LP leg 128 rather than the sump system 124. Accordingly, backflow from the sump system 124 through the diverter and separator sump valve 150 can be avoided under pressurization from the charge gas via charge gas valve 156.

The control system 138 illustratively includes HP valve 166 and LP valve 154 each operable to selectively communicate liquids from their respective sources. In the illustrative embodiment, the LP valve 154 is operated by the control system 138 to communicate liquids from the LP leg 128 to the sump system 124 or to the LP leg 128 during (or close-in-time with) the sump evacuation operations. In the illustrative embodiment, when the LP valve 154 is open, fluids from the LP leg 128, LP sources, and/or (selectively) the inlet separator system 120 can flow to the sump system 124 via natural (i.e., gravity) feed, and when the control system 138 operates LP valve 154 to close, those fluids are directed to the LP leg 128 via line 129. The control system 138 illustratively operates the LP valve 154 to close during sump evacuation options. In some embodiments, opening of other valves communicating with the LP leg 128, such as HP vapor valve 172, may selectively close the LP valve 168 when backflow conditions would exist. Optionally, the control system 138 may include an LP source valve 168 for selective operation to govern LP source fluids.

Accordingly, in the illustrative embodiment, liquids of the LP leg 28 are maintained at appropriate levels by open communication via LP valve 154, but can be held within the LP leg 28 as needed, for example, during sump evacuation operations to purging sump fluids. In some embodiments, the control system 138 may include an LP sump valve for selective communication of LP liquids to the sump system 124 operating from closed to open, responsive to threshold liquid level within the LP leg 28 via level detector 161, to communicate LP fluids to the sump system 124.

Referring still to FIG. 6, the control system 138 includes vapor control valves 164, 172 each operable to communicate gaseous fluids to the LP leg 128. In the illustrative embodiment, the sump vapor valve 164 can communicate gaseous fluids from the sump system 124 to the LP leg 128. The control system 138 illustratively maintains sump vapor valve 164 open during normal operation (e.g., non-sump evacuation operations), and closes sump vapor valve 164 during sump evacuation operations. In some embodiments, the control system 128 may open valve 164 responsive to threshold pressure, via pressure sensor, within the sump system 124 and absent sump evacuation operations, and may close sump vapor valve 164 upon threshold low pressure within the sump system 124. In some embodiments, the control system 38 may close other valves communicating with the LP leg 128, such as HP vapor valve 172 when the sump vapor valve 164 is open. In some embodiments, any suitable control operation of sump vapor valve 164 and corresponding operation of other valves communicating with the LP leg 128 may be applied may be applied, for example, less than threshold liquid level within the sump system 124.

In the illustrative embodiment, the control system 138 operates HP vapor valve 172 to communicate gaseous fluids from the HP leg 126 to the LP leg 128. The control system 138 illustratively operates HP vapor valve 172 open to communicate gaseous fluids via a vapor line to the LP leg 128 responsive to threshold pressure, via pressure sensor 163, within the HP leg 126; and closes HP vapor valve 172 upon threshold low pressure within the HP leg 126. In some embodiments, any suitable control operation of HP vapor valve 172 may be applied, for example, less than threshold liquid level within the sump system 124. In some embodiments, the control system 138 may close other valves communicating with the LP leg 128, such as sump vapor valve 164 when the HP vapor valve 172 opens. In some embodiments, any suitable control operation of HP vapor valve 172 and corresponding operation of other valves communicating with the LP leg 128 may be applied, for example, less than threshold liquid level within the HP leg 126.

The control system illustratively includes HP sump valve 162 for selective communication of fluids from the HP leg 126 to the sump system 120. The control system 138 illustratively operates HP sump valve 162 open to communicate liquids sump system 128 responsive to threshold liquid level, via level detector 165, within the HP leg 126; and closes HP sump valve 126 upon threshold acceptable liquid level within the HP leg 126. In some embodiments, the control system 138 may close other valves communicating with the LP leg 128, such as sump vapor valve 164 when the HP vapor valve 172 opens. In some embodiments, any suitable control operation of HP sump valve 162 and corresponding operation of other valves communicating with the sump system 124 or HP leg 126 may be applied, for example, greater than threshold pressure within the HP leg 126.

Referring still to FIG. 6, the methane recovery system 134 can increase pressure of hydrocarbon gas for (re)introduction to the inlet separator system 120. In the illustrative embodiment, the methane recovery compressor 136 draws gaseous fluids from the LP leg 28, compresses the drawn fluids to increase the pressure, and provides the pressurized recovered hydrocarbon gas to the inlet separator system 120.

The control system 138 illustratively governs methane recovery system 134 operation. For example, the control system 138 can activate and/or control speed and/or output pressure from compressor 136 based on pressure levels within either or both of the LP leg 28 and the inlet separator 120, via pressure sensors. The control system 138 illustrative includes a gas recovery control valve 170 for selective communication of gaseous fluids to the methane recovery system 134.

The methane recovery system 134 illustratively includes a gas scrubber 184 arranged to receive gas from the charge system 122 for treatment before entering the methane recovery compressor 136. The gas scrubber 182 is illustratively arranged to reduce entrained liquids prior to compression. Ultra low pressure methane can be admitted from other sources to the methane recovery system 134, in addition to the gas from the charge system 122, for example, from the gas compression system 116. Such ultra low pressure methane can be gas leakage from early stage compressors, vent packing leakage, and/or compressor blowdown from depressurization during maintenance in the gas compression system 116. Such ultra low pressure sources can be on the order of mere ounces of pressure above atmosphere, and thus, can present challenging recovery issues.

As previously mentioned, the sump system 124 may receive heat from the heating system 130 via the heating device 132 for encouraging vaporization of fluids within the sump system 124 for recovery as gaseous fluids. In the illustrative example, the heating device 132 is formed as a heat exchanger adapted for thermal communication with other components, namely the methane recovery system 134.

The heating system 130 illustratively includes a heating fluid path 180 (e.g., piping) for circulating a heating fluid between the heating device 132 and the methane recovery system 134. The heating fluid path 180 is illustratively adapted to circulate heating fluid, via pump 182, in thermal communication with each of the heating device 132 and the methane recovery compressor 136 to transfer heat from the compressor 136 to the heating device 132.

The heating device 132 is arranged in thermal communication with the fluids within the sump system 124. In the illustrative embodiment, the heating device 132 is formed as a heating coil submersed within the liquid level of the sump vessel of the sump system 124. Heating fluid circulated from the methane recovery system 134 through the heating device 132 is transfer to the fluids within the sump system 124 to increase the temperature and encourage vaporization. Cooled heating fluid is returned to the methane recovery system 134 for reheating.

Heating fluid circulated through the methane recovery system 134 is illustratively passed through an in-situ cooling heat exchanger of the compressor 182 to remove heat from the compressor 182. In some embodiments, the heating fluid may circulate through an intermediary heat exchanger arranged in thermal communication with the compressor 182 via a coolant refrigerant.

It should be understood that the foregoing description provides embodiments of the present invention which can be varied and combined without departing from the spirit of this disclosure. More specifically, it should be understood that the apparati and processes described herein, although described in terms of a lift gas application, could be utilized on many gas compression systems to avoid venting gas into the atmosphere. To the extent that the different aspects disclosed can be combined, such combination are disclosed herein.

Those of skill in the art should, in light of the present disclosure, appreciate that many changes can be made in the specific embodiments which are disclosed and still obtain a like or similar result without departing from the concept, spirit and scope of the present disclosure.

What is claimed is:

1. A gas lift gas recovery system comprising:

an inlet separator system configured to receive production fluid for separation of liquids therefrom to recover gas lift gas, the inlet separator system comprising at least one separator vessel for separation of liquids from gas, the at least one separator vessel including a production inlet to receive production fluid from a well, a gas lift gas outlet for connection with a gas lift gas compressor system, and a liquid outlet;

a charge system including a high pressure (HP) leg for holding an HP portion of fluid and a low pressure (LP) leg for holding an LP portion of fluid, a liquid inlet for selective communication with the liquid outlet of the inlet separator to receive liquids; and a sump system for holding liquids from at least one of the inlet separator system and the charge system, the sump system comprising a sump vessel arranged for selective communication with the charge system via a vapor line to transfer vaporous release to the charge system; and a control system for operation to conduct selective communication of fluids, wherein the control system is configured to selectively communicate the sump system with at least one of the inlet separator system and the charge system to transfer liquids to the sump system.

2. The gas lift gas recovery system of claim 1, wherein the control system includes a charge gas valve for communicating pressurized charge gas to the sump system and a sump outlet valve for purging liquids from the sump system, wherein the control system is configured to open the sump outlet valve and the charge gas valve in response to a threshold sump fluid level within the sump vessel to purge liquids from the sump vessel.

3. The gas lift gas recovery system of claim 1, wherein the control system includes a sump vapor control valve operable between a closed position to block against communication of vaporous release to the charge system and an open position to fluidly communicate the sump system with the charge system to transfer vaporous fluids to the charge system.

4. The gas lift gas recovery system of claim 3, wherein the control system is configured to close the sump vapor control valve in response to sump purging operations.

5. The gas lift gas recovery system of claim 3, wherein the control system is configured to close one or more valves arranged for selective communication of liquid to the sump system in response to the sump purging operations.

6. The gas lift gas recovery system of claim 1, wherein the sump system is arranged to receive selective communication of liquid from at least one of a fuel gas scrubber system, a suction scrubber, a first interstage scrubber, and a drain of a gas lift gas compressor system.

7. The gas lift gas recovery system of claim 6, wherein the liquid from the at least one of a fuel gas scrubber system, a suction scrubber, a first interstage scrubber, and a drain of a gas lift gas compressor system is an LP liquid for selective communication to the sump system via a valve of the control system.

8. The gas lift gas recovery system of claim 1, wherein the charge system is arranged to receive selective communication of liquid from at least one of a second interstage scrubber and a third interstage scrubber.

9. The gas lift gas recovery system of claim 8, wherein the liquid from the at least one of a second interstage scrubber and a third interstage scrubber is an HP liquid for selective communication to the HP leg of the charge system.

10. The gas lift gas recovery system of claim 9, wherein the liquid from the at least one of a second interstage scrubber and a third interstage scrubber is arranged for selective communication from the HP leg of the charge system to the sump system via an HP sump valve of the control system.

11. The gas lift gas recovery system of claim 1, wherein the inlet separator system is arranged in selective communication with the sump system to provide liquids via a separator sump valve of the control system.

12. The gas lift gas recovery system of claim 11, wherein the inlet separator system is arranged in selective communication with the charge system, and the control system is configured to selectively communicate liquids from the inlet separator system to the charge system in response to threshold liquid level within the inlet separator system during dump cycle operation of the sump system for purging liquids from the sump vessel.

13. The gas lift gas recovery system of claim 1, wherein the gas lift gas recovery system is skid mounted.

14. The gas lift gas recovery system of claim 1, further comprising a methane recovery system for recovering hydrocarbon gas.

15. The gas lift gas recovery system of claim 14, wherein the methane recovery system includes a methane recovery compressor for increasing pressure of recovered gas.

16. The gas lift gas recovery system of claim 15, wherein pressurized gas from the methane recovery compressor is provided to the inlet separator for combination with recovered gas lift gas.

17. The gas lift gas recovery system of claim 14, wherein the methane recovery system includes a cooling system, the cooling system comprising a heat transfer fluid circulating in thermal communication to remove heat from the methane recovery system and provide recovered heat to the sump system.

18. The gas lift gas recovery system of claim 17, wherein the sump system includes a heat exchanger arranged to provide thermal communication between the heat transfer fluid and the sump vessel to provide heat to the liquids within the sump vessel for encouraging vaporization.

19. The gas lift gas recovery system of claim 1, wherein the control system is configured to selectively communicate the sump system with the inlet separator system to transfer liquids to the sump system in response to threshold liquid level within the at least one of the inlet separator system.

20. The gas lift gas recovery system of claim 19, wherein, during sump purging operation, the control system is configured to divert fluids from the inlet separator system to the LP leg in response to threshold liquid level within the inlet separator system during sump purging operations.

21. The gas lift gas recovery system of claim 20, wherein the control system is configured to maintain communication of liquid from the LP leg to the sump system outside of sump purging operations.

22. The gas lift gas recovery system of claim 1, wherein the control system is configured to selectively communicate the sump system with the HP leg of the charge system to transfer liquids to the sump system in response to threshold liquid level within the HP leg.

23. A gas lift gas recovery system comprising:

an inlet separator system configured to receive production fluid for separation of liquids therefrom to recover gas lift gas, the inlet separator system comprising at least one separator vessel for receiving production fluid from a well and separating liquids from gas within the production fluid;

a charge system including a high pressure (HP) leg for holding an HP portion of fluid and a low pressure (LP) leg for holding an LP portion of fluid, a liquid inlet for selective communication with the inlet separator system to receive liquids; and a sump system for holding liquids from at least one of the inlet separator system and the charge system, the sump system comprising a sump vessel arranged for selective communication with the charge system to transfer vaporous release to the charge system;

a control system for operation to conduct selective communication of fluids, wherein the control system is configured to selectively communicate the sump system with at least one of the inlet separator system and the charge system to transfer liquids to the sump system; and a methane recovery system for recovering methane from at least one of the sump system and the charge system.

24. The gas lift gas recovery system of claim 23, wherein the methane recovery system includes a methane recovery compressor for increasing pressure of recovered gas.

25. The gas lift gas recovery system of claim 24, wherein pressurized gas from the methane recovery compressor is provided to the inlet separator for combination with recovered gas lift gas.

26. The gas lift gas recovery system of claim 23, wherein the gas lift gas recovery system includes a skid on which at least the inlet separator system, the charge system, and the sump system are mounted.

27. The gas lift gas recovery system of claim 26, wherein the methane recovery system is mounted on the skid.

28. The gas lift gas recovery system of claim 26, wherein the control system is mounted on the skid.

29. A gas lift gas preparation system comprising:

a gas lift gas recovery system for recovering gas lift gas from well production fluid, the gas lift gas recovery system comprising:

an inlet separator system configured to receive production fluid for separation of liquids therefrom to recover gas lift gas, the inlet separator system comprising at least one separator vessel for receiving production fluid from a well and separating liquids from gas within the production fluid;

a charge system including a high pressure (HP) leg for holding an HP portion of fluid and a low pressure (LP) leg for holding an LP portion of fluid, a liquid inlet for selective communication with the inlet separator system to receive liquids;

a sump system for holding liquids from at least one of the inlet separator system and the charge system, the sump system comprising a sump vessel arranged for selective communication with the charge system to transfer vaporous release to the charge system; and a control system for operation to conduct selective communication of fluids, wherein the control system is configured to selectively communicate the sump system with at least one of the inlet separator system and the charge system to transfer liquids to the sump system;

and a gas compression system for compression of recovered gas lift gas from the inlet separator system, the gas compression system including at least one compressor arranged for communication with the inlet separator system to receive recovered gas lift gas, and in communication to provide compressed gas lift gas for gas lift.

* * * * *